United States Patent [19]

Brand

[11] Patent Number: 4,491,270

[45] Date of Patent: Jan. 1, 1985

[54] THERMALLY ACTUATED DIFFUSER

[75] Inventor: Peter Brand, San Francisco, Calif.

[73] Assignee: Acutherm, Ltd., Emeryville, Calif.

[21] Appl. No.: 459,469

[22] Filed: Jan. 20, 1983

[51] Int. Cl.[3] ..... F24F 13/10

[52] U.S. Cl. ..... 236/49; 165/28; 236/1 C

[58] Field of Search ..... 236/49, 1 C; 98/40 VT; 165/16, 27, 28, 39, 40

[56] References Cited

U.S. PATENT DOCUMENTS

| | | | |
|---|---|---|---|
| Re. 30,953 | 6/1982 | Vance et al. | 236/49 |
| 3,743,180 | 7/1973 | Perkins et al. | 236/49 X |
| 4,238,071 | 12/1980 | Post | 62/186 X |

*Primary Examiner*—William E. Tapolcai

*Attorney, Agent, or Firm*—Manfred M. Warren; Robert B. Chickering; Glen R. Grunewald

[57] ABSTRACT

An improved thermally actuated diffuser is disclosed. The diffuser comprises four thermal sensor actuators. A first thermal sensor actuator is responsive to changes in the room air temperature when cool air is supplied through the duct into the room. A second thermal sensor actuator is responsive to the duct air and is adapted to engage the first thermal sensor actuator when cool air is supplied through the duct and to disengage the first thermal sensor actuator when warm air is supplied through the duct. A third thermal sensor actuator is responsive to changes in the room when warm air is supplied through the duct. A fourth thermal sensor actuator is responsive to changes in the duct air temperature and brings the third thermal sensor actuator into engagement when warm air is supplied through the duct and to disengage the third thermal sensor actuator when cool air is supplied through the duct.

8 Claims, 10 Drawing Figures

THERMALLY ACTUATED DIFFUSER

DESCRIPTION

1. Technical Field

The present invention relates to an improved thermally actuated diffuser and, more particularly, to a diffuser unit for delivering a variable, modulated volume of air to a room or other space in response to changes in the temperature of the air in that room or other space.

2. Background Art

Thermally actuated diffuser in which conditioned air is delivered to a room or other space is well-known in the art. U.S. Pat. No. 4,231,513, issued on Nov. 4, 1980 and re-issued June 1, 1982 (U.S. Pat. No. Re. 30,953), discloses a diffuser which delivers a modulated, variable volume of conditioned air to a room or other space in the building.

An integrated sensor actuator which both senses temperature changes in the room and also provides the actuating force for varying the amount of air flow into the room in response to the sensed temperature is disclosed in said patent. In addition, that reference teaches a second integrated sensor actuator that measures the temperature of the duct air and provides the actuating force to convert the operation of the diffuser from one mode, i.e., delivery of cool air into the room, to a second mode, i.e., delivery of warm air into the room, during a period called changeover. In the changeover period, such as during morning warm-up, the room is brought up to the desired temperature after the air temperature in the room had been permitted to fall substantially below the desired temperature such as during a weekend when the room is not being used. Typically, hot air is blown through the branch duct only for a limited short period of time, usually about half an hour, just shortly before the start on normal working hours on a Monday morning. Thereafter, cool air is delivered through the duct and the operation of the diffuser returns to the modulation of that cool air.

SUMMARY OF THE INVENTION

In the diffuser of the present invention, in one particular embodiment, the diffuser comprises a first sensor actuator means which is responsive to a first room air temperature, and is for modulating the flow control means when air of one temperature is supplied through the duct. A second sensor actuator means is responsive to the duct air temperature and is for engaging the first sensor actuator means with the flow control means when air of one temperature is supplied through the duct and disengaging the first sensor actuator means with the flow control means when air of another temperature is supplied through the duct. A third sensor actuator means is responsive to a second room air temperature and is operatively associated with the flow control means for modulating the flow control means when air of another temperature is supplied through the duct. A fourth sensor actuator means is responsive to the duct air temperature and engages the third sensor actuator means with the flow control means when air of the other temperature is supplied through the duct and disengages the third sensor actuator means with the flow control means when air of one temperature is supplied through the duct.

In another embodiment of the present invention, a diffuser comprises a flow control means for varying the size of an aperture in the diffuser to regulate the volume flow of air from the duct through the diffuser and into the room. A first sensor actuator means is responsive to a first room air temperature and is operatively associated with the flow control means for modulating the flow control means in a normally closed-to-open mode of operation in response to changes in the room air temperature when air of one temperature is supplied through the duct. A second sensor actuator means is responsive to a first duct air temperature and disengages the first sensor actuator means with the flow control means when air of another temperature is supplied through the duct. A third sensor actuator means is responsive to a second room air temperature and is operatively associated with the flow control means for modulating the flow control means in a normally open-to-closed mode of operation in response to changes in room temperature when air of another temperature is supplied through the duct. A fourth sensor actuator means is responsive to a second duct air temperature and engages the third sensor actuator means with the flow control means when air of another temperature is supplied through the duct.

In yet another embodiment of the present invention, the diffuser comprises a flow control means for varying the size of an aperture in the diffuser to regulate the volume flow of air from the duct through the diffuser and into the room. A first sensor actuator means is responsive to a first room air temperature and is operatively associated with the flow control means for modulating the flow control means in a normally closed-to-open mode of operation in response to changes in room temperature when air of one temperature is supplied through the duct. A second sensor actuator means is responsive to the duct air temperature and is for opening the aperture when air of another temperature is supplied through the duct. The air of another temperature is warmer than the air of the one temperature. The first sensor actuator means closes the aperture and reopens it in response to air of another temperature supplied to the room. The first sensor actuator is disengaged from the flow control means. A third sensor actuator means is responsive to a second room air temperature and is operatively associated with the flow control means for modulating the flow control means in a normally open-to-closed mode of operation in response to changes in room temperature when air of another temperature is supplied through the duct. A fourth sensor actuator means is responsive to duct air temperature and engages the third sensor actuator means with the flow control means when air of another temperature is supplied through the duct.

BRIEF DESCRIPTION OF THE DRAWINGS

In FIG. 1, part of the appearance plate has been broken away to shown details of the diffuser plate, the louvers (or vanes) at the edges of the diffuser plate, the thermal sensor actuators, the louver control disc, and the linkage rod extending from the louver control disc to the louvers.

DETAILED DESCRIPTION OF THE DRAWINGS

Figure 1:
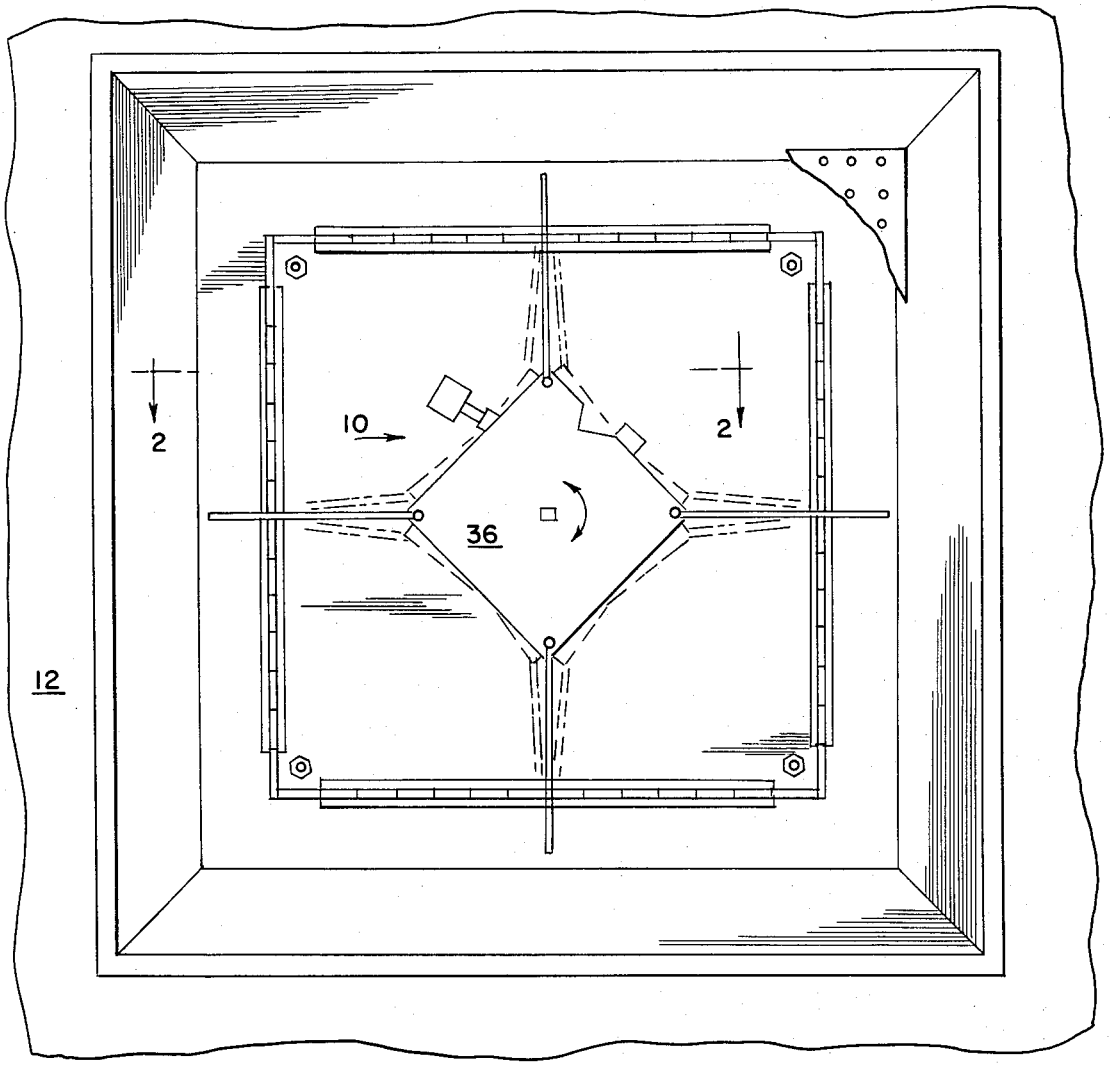
FIG. 1 is a bottom plan view of a part of a modular ceiling showing a thermally actuated diffuser of the present invention.

A thermally actuated, variable air volume diffuser of the present invention is indicated generally by the reference numeral 10 in FIG. 1. FIG. 1 is a bottom plan view looking upwardly at a room ceiling. The ceiling, as illustrated in FIG. 1, is a modular ceiling comprising a number of individual modules 12. The diffuser 10 of the present invention is installed in the ceiling in the place of one of the modules 12. The diffuser 10 distributes a variable volume of air to the room, or other space from a branch duct 20, and the amount of air flowing through the diffuser 10 is modulated in response to changes in the temperature of the air in the room, as will be described in detail below.

The diffuser 10 comprises a diffuser can 14, an appearance plate 16, and a diffuser plate 18. The diffuser plate 18 serves both as a plate for directing the air flow, as well as a support structure for the operative component for the diffuser. The air from the branch duct 20 (shown by arrow A) flows from the branch duct 20 and is deflected by the diffuser plate 18 outwardly to the periphery 22 of the diffuser plate 18 for subsequent flow down along the inner surfaces 22 of the related, inclined sidewalls of the can 14.

This flow of air induces a certain amount of room air up through the appearance plate 16 (shown by arrow B). This induced room air flows over the thermal sensor actuator assembly 30 to be described in greater detail. The air leaving the periphery 22 of the diffuser can 14 is directed at an angle with respect to the adjacent ceiling panels 12 so as to provide a maximum Coanda effect and to thereby cause the diffused air to hug the ceiling and to avoid dumping.

Figure 2:
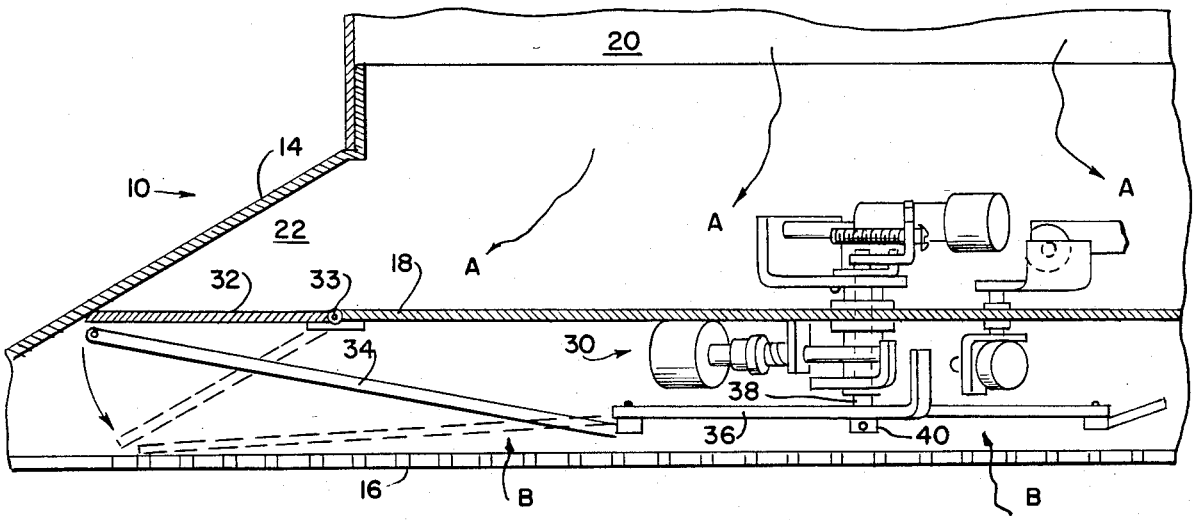
FIG. 2 is a side elevation view taken along the line and in a direction indicated by the arrows 2—2 in FIG. 1.

In the embodiment shown in FIG. 1, four louvers or vanes 32 are connected by hinges 33 to the diffuser plate 18. Each louver 32 is movable from a fully closed position (in which the outer edge of the louver engages the inside surface 22, as shown in FIG. 2) to a fully open position (as shown by the dotted line in FIG. 2). The control of the movement of each louver 32 being between the fully closed position and the fully open position and all intermediate positions is produced by a rod 34 and a louver control disc 36. The louver control disc 36 is, in turn, connected to a shaft 38 by a locking nut 40 for rotation with the shaft 38. The rotation of the disc 36 causes the modulation of the opening of the vanes 32.

Figure 3:
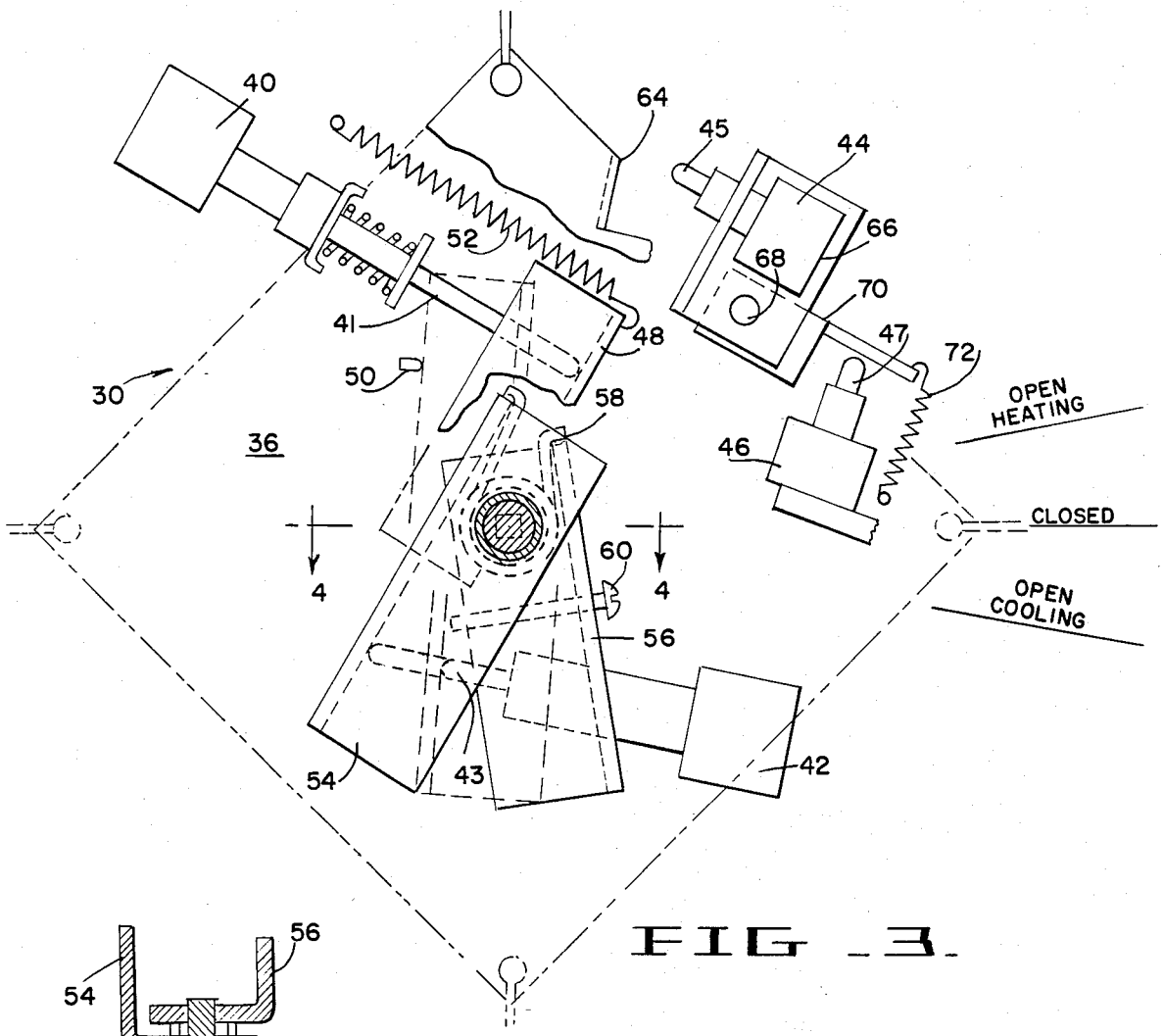
FIG. 3 is a plan view of a portion of the diffuser of the present invention showing the thermal sensor actuators.

Referring to FIG. 3, there is shown in greater detail the thermal assembly 30 of the diffuser 10 of the present invention. A first thermal sensor actuator 40 is located to one side of the diffuser plate 18 and is for measuring the air temperature of the room. A second thermal sensor actuator 42 is located to the other side of the diffuser plate 18 and is for measuring the air temperature of the duct 20. A third thermal sensor actuator 44 is located to the one side of the diffuser plate 18, on the same side as the first thermal sensor actuator 40. A fourth thermal sensor actuator 46 is located to the other side of the diffuser plate 18, on the same side as the second thermal sensor actuator 42. The thermal sensor actuators 40, 42, 44, and 46 can be of the type commonly used in automotive applications and are distributed by Robertshaw Controls Co. (Fulton Sylphon Division).

The first thermal sensor actuator 40 has a shaft 41 which is aligned to actuate a first member 48 moving it away from a stop 50 which is affixed to the diffuser plate 18. The first member 48 is normally biased to rest against stop 50 by a first spring 52. The first member 48 is connected to the outer sleeve 62 of the center shaft 38. On the other side of the diffuser plate 18 is a second member 54. The second member 54 is also connected to the outer sleeve 62 of the center shaft 38. A third member 56 is directly connected to the center shaft 38. A second torsion spring 58 closes the angular distance between the second and the third members 54 and 56, respectively. The second member 54 is brought to a stop against an adjusting screw 60 in the third member 56. The second thermal sensor actuator 42 is mounted on the third member 56.

The control disc 36 has a tab 64 on the one side of the diffuser plate 18. The third thermal sensor actuator 44 with its shaft 45 is aligned to impinge the tab 64. The third thermal sensor actuator 44 is mounted on a fourth member 66, which, in turn, is pivotally mounted on a second shaft 68. The second shaft 68 extends through the diffuser plate 18. On the other side of the diffuser plate 18, a fifth member 70 is pivotally connected to the second shaft 68. The fourth thermal sensor diffuser 46 with its shaft 47 is aligned to impinge the fifth member 70. A third spring 72 biases fifth member 70 against the shaft 47 of the fourth thermal sensor actuator. The operation of the diffuser 10 is as follows:

Cooling Mode

In this mode of operation, cool air is supplied from the branch duct 20. Since cool air is supplied in the duct 20, the second thermal sensor actuator 42 being cooled would be fully retracted. The angular distance between the second and the third members 54 and 56, respectively, is at a minimum, i.e., the second member 54 being at a full stop against the adjusting screw 60. Since the room is cool, the first thermal sensor actuator 40 would also be fully retracted. The first member 48 would be retracted by the first spring 52 coming to rest against the stop 50. Since the third member 56 is directly connected to the control disc 36 through the center shaft 38, the control disc 36 is in the center "Closed" position. The fourth thermal sensor actuator 46 would also be fully retracted. Thus, the second thermal sensor actuator 44 with its shaft 45 would be disengaged from the tab 64. The damper blades 32 would be closed.

As the room begins to warm up, due to changing load conditions the first thermal sensor actuator 40 begins to expand. The shaft 41 pushes the first member 48 away from the fixed stop 50. The first member 48 transmits its rotational motion via the outer sleeve 62 of the center shaft 38. The rotation of the outer sleeve 62 rotates the second member 54. This rotational movement is transmitted to the third member 56 by the second torsion spring 58. The rotation of the third member 56 is then transmitted through the center shaft 38 to the control disc 36. The disc is then moved to the "Open Cooling" position. This opens the louvers 32 to a position whereby cool air is supplied to the room. It should be noted that since the third thermal sensor actuator 44 is disengaged from the tab 64, the changes in the room temperature has no effect on the third thermal sensor actuator 44 when cool air is supplied through the duct 20.

When the demand for cool air in the room is satisfied, the first thermal sensor actuator 40 will retract the shaft 41. The above-described motions will reverse until the control disc 36 is again at the "Closed" position. This then closes the louvers 32.

Heating Mode

In the heating mode, warm air is supplied through the branch duct 20. The warm air heats the fourth thermal sensor actuator 46. The expansion of the shaft 47 of the fourth thermal sensor actuator 46 brings the second thermal sensor actuator 44, with its shaft 45, into engagement with the tab 64.

The warm air also heats the second thermal sensor actuator 42. The expansion of the shaft 43 of the second thermal sensor actuator 42 pushes the second member 54 away from the third member 56 against the force of the second torsion spring 58. The second member 54 is connected by the outer sleeve 62, to the first member 48, which is biased by the first spring 52 to rest against the stop 50. Thus, the movement of the third member 56 away from the second member 54 results in a rotation of the center shaft 38 in a counter-clockwise direction to the "Open Heating" position.

Warm air now enters into the room. As the room air temperature warms up, the first thermal sensor actuator 40, which has a lower temperature sensitivity than the third thermal sensor actuator 44, becauses it is responsive to cool air supplied through the branch duct 20, will first begin to expand. The expansion of the shaft 41 of the first thermal sensor actuator 40 pushes against the first member 48. The rotational movement of the first member 48 about the center shaft 38 is transmitted to the second member 54 through the outer sleeve 62. This rotational movement is, in turn, transmitted to the third member 56 through the second torsion spring 58. The rotation of the third member 56 then rotates the control disc 36 in a clockwise direction. The rotation of the control disc 36 moves from the "Open Heating" position through the "Closed" position into the area between the "Closed" position and the "Open Cooling" position. Since the louvers 32 are still open, warm air continues to be supplied into the room.

When the room air temperature reaches the temperature set point of the third thermal sensor actuator 44, the third thermal sensor actuator 44 begins to expand. The shaft 45 of the third thermal sensor actuator 44 pushes against the tab 64 and moves the control disc 36 in a counterclockwise direction. When the room air temperature is at the temperature setting of the third thermal sensor actuator 44, the control disc will have been rotated to the "Closed" position. This closes the louvers 32.

In the event the room cools down, the third thermal sensor actuator 44 would retract. However, since the first thermal sensor actuator 40 is responsive to a lower temperature, it would still be activated. Its shaft 41 would continue to push against the first member 48, thereby causing the control disc 36 to rotate in a clockwise direction towards the "Open Cooling" position. This opens the louvers 32 and permits warm air to enter into the room. The process will continue until as previously described; the room air temperature reaches the temperature set point of the third thermal sensor actuator 44, at which point the control disc 32 is rotated to the "Closed" position, closing off the louvers 32.

Thus, in this embodiment, when warm air is supplied through the duct 20, the thermal assembly 30 moves the control disc 36 and modulates the opening of the louvers between the position designated as "Closed" and the position designated as "Open Cooling". The control disc 36 is moved to the "Open Heating" position only transiently when warm air is initially brought through the duct 20 into the room. Once the room air temperature is brought above the temperature set point of the first thermal sensor actuator 40, thereby moving the control disc 36 to the position between the "Closed" and the "Open Cooling" positions, the modulation of the louvers 32 is between these two positions of the control disc 36.

Figure 4:
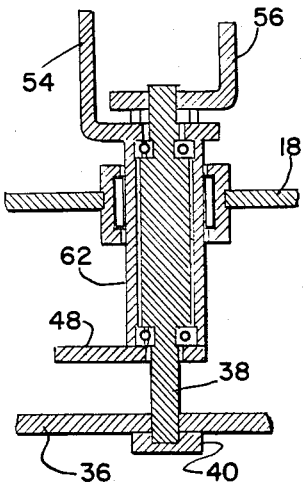
FIG. 4 is a cross-sectional view taken along the line 4—4 of FIG. 3.
Figure 5:
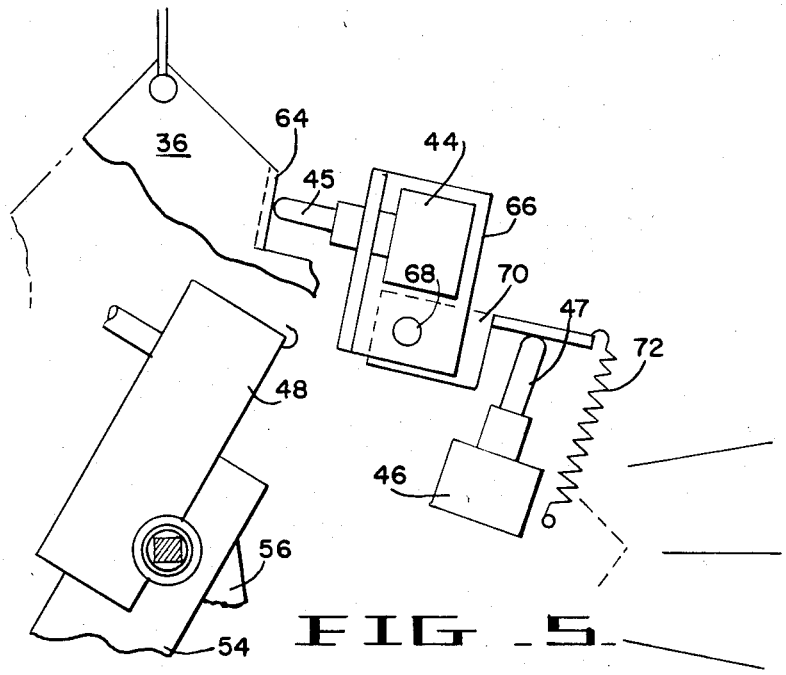
FIG. 5 is a greatly enlarged view of a portion of the thermal assembly shown in FIG. 3.
Figure 6:
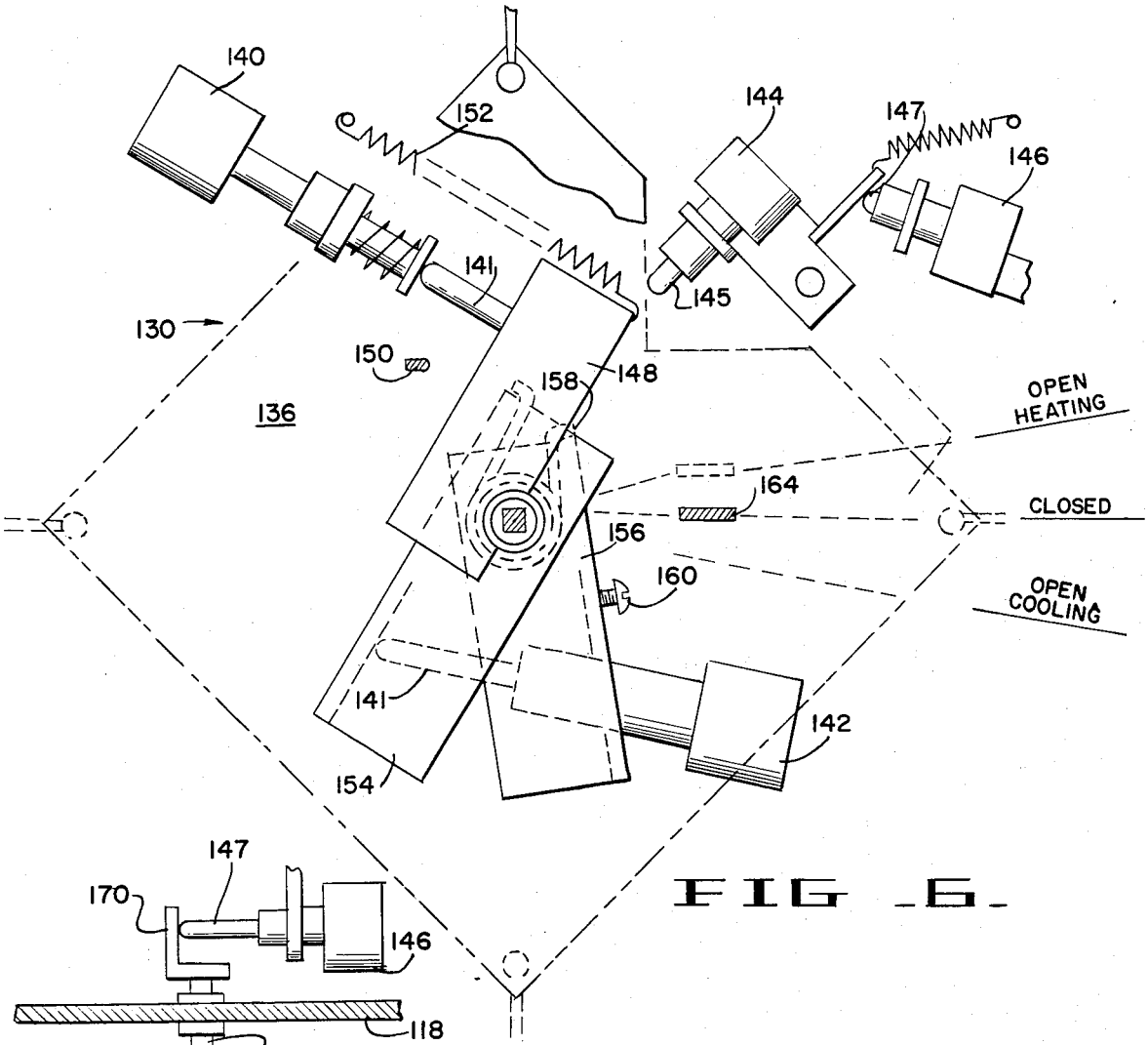
FIG. 6 is a greatly enlarged view of another thermal assembly of a diffuser of the present invention.
Figure 8:
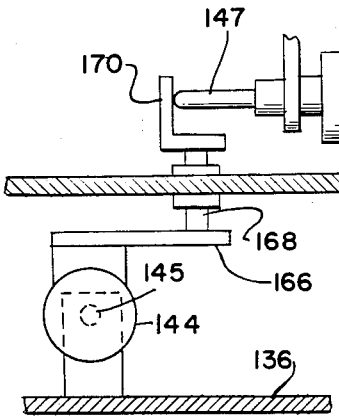
FIG. 8 is a cross-sectional view taken along the line 8—8 of FIG. 7.
Figure 7:
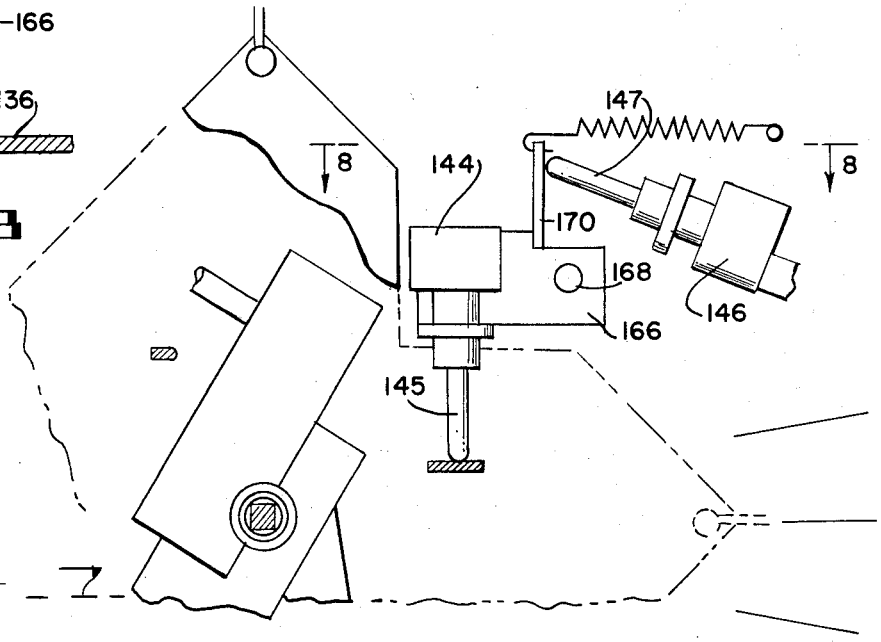
FIG. 7 is another greatly enlarged view of a portion of the thermal assembly of FIG. 6.

Referring to FIG. 6, there is shown a variation of the thermal assembly 30 of FIGS. 3-5. In the thermal assembly 130 shown in FIG. 6, all of the elements of the thermal assembly 30 are present in the thermal assembly 130. The only change is in the position of the tab 64. In the thermal assembly 130, the tab 164 is located in a position such that the rotation of the control disc 136 in a counterclockwise direction caused by warm air being supplied through the branch duct 20 will bring the tab 164 into engagement with the shaft 145 of the third thermal sensor actuator 144. This is shown in FIG. 7. The effect of the change in the position of the tab 164 on the operation of the thermal assembly 130 is as follows:

Cooling Mode

In this mode of operation, when cool air is supplied through the duct 20, there is no change in the operation of the thermal assembly 130 from the operation of the thermal assembly 30 as shown and as described in FIG. 3.

Heating Mode

In this mode of operation, when warm air is supplied through the duct, the warm air causes the second thermal sensor actuator 142 to expand. This pushes the second member 154 away from the third member 156 against the force of the second torsion spring 158. Since the first member 148, which is connected to the second member 154, by the outer sleeve 162, is biased to rest against the stop 150 by the first spring 152, the movement of the third member 156 away from the second member 154 results in a rotation of the center shaft 138. This causes the control disc 136 to be moved in counterclockwise direction to the "Open Heating" position.

The warm air supplied through the duct 20 also expands the fourth thermal sensor actuator 146. The expansion of the shaft 147 of the fourth thermal sensor actuator 146 brings the third thermal sensor actuator 144 into a position to engage the tab 164. When the control disc 136 is rotated to the "Open Heating" position, the tab 164 will come to a stop against the shaft 145 of the second thermal sensor actuator 144, thereby preventing further rotation of the control disc 136.

As the warm air in the duct 20 further warms the second thermal sensor actuator 142 causing its shaft 141 to expand, the shaft 141 would push the second member 154 away from the third member 156. Since the control disc 136 can no longer rotate any further, the movement of the second member 154 in a clockwise direction causes the first member 148 to rotate in a clockwise direction, thereby disengaging from the first thermal sensor actuator 140.

When the temperature of the room air nears the set point of the first thermal sensor actuator 140, the first thermal sensor actuator 140 begins to expand. However, since the first member 148 is disengaged from the first thermal sensor actuator 140, the expansion and activation of the first thermal sensor actuator 140 has no effect on the diffuser 10.

As the demand of the room temperature nears the temperature set point of the third thermal sensor actuator 144, the shaft 145 of the third thermal sensor actuator begins to expand. The third thermal sensor actuator 144 pushes against the tab 164 and moves the control disc 136 from the position of "Open Heating" to the "Closed" position, thereby closing off the louvers 32.

In the event the room cools down, and further warm air is desired, the third thermal sensor actuator 144 will retract. Since the second thermal sensor actuator 142 senses the duct air temperature, it continues to be affected by the warm duct air. The second thermal sensor actuator 142 continues to expand rotating the disc 136 in a counter-clockwise direction until the tab 164 comes to rest against the shaft 145 of the third thermal sensor actuator 144. This opens the louvers 32.

Therefore, from the foregoing description, the thermal assembly 130 modulates the opening of the louvers 32 by a control disc 136 which moves between the position of "Closed" and the position of "Open Heating". Furthermore, during the operation of the modulation of the opening of the louvers 32, the first thermal sensor actuator 140 is totally disengaged from the operation of the thermal assembly 130.

Slot Diffuser (Linear Diffuser)

Figure 9:
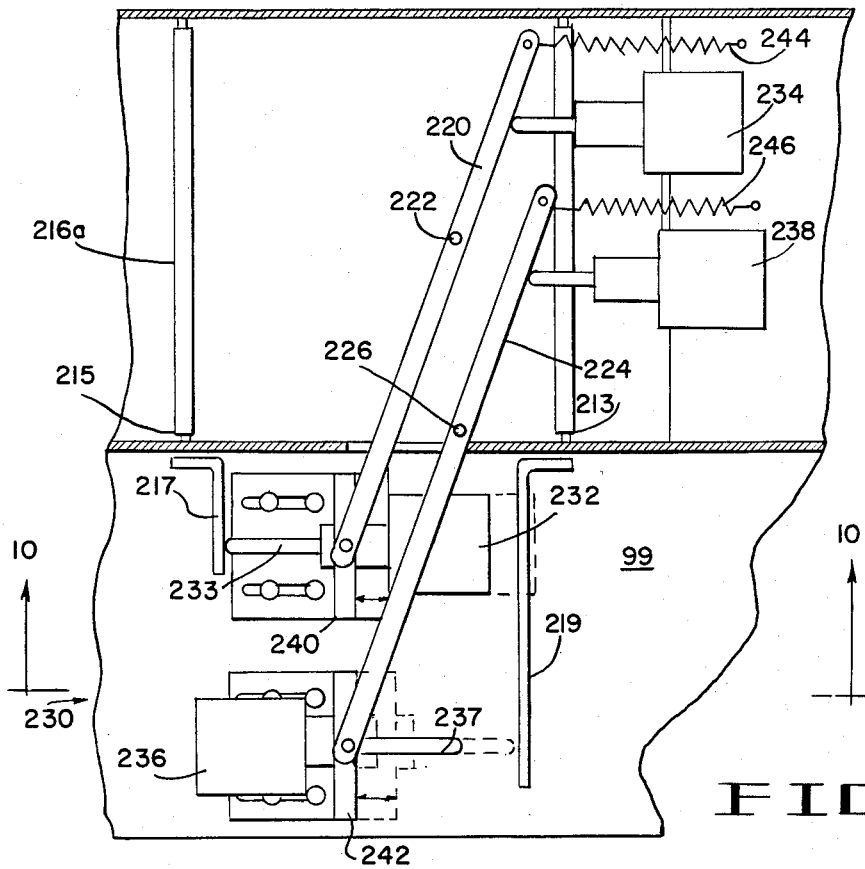
FIG. 9 is a top view of another diffuser of the present invention, showing the thermal assembly.
Figure 10:
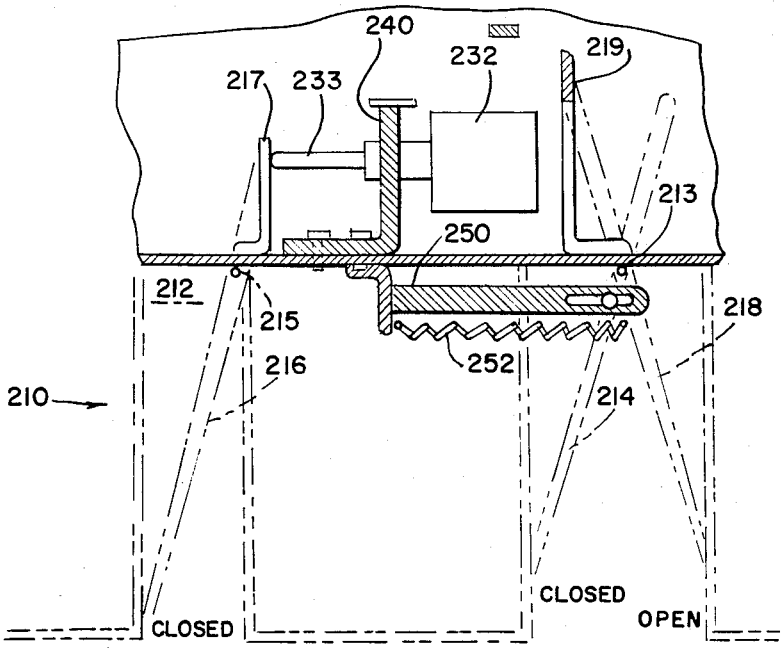
FIG. 10 is a cross-sectional side view taken along the line 10—10 of FIG. 9.

Referring to FIG. 9, there is shown another diffuser 210 of the present invention. The diffuser 210 is of a type known as a "slot diffuser" or "linear diffuser." In the slot diffuser 210 of the present invention, two slots 212 and 214 are shown, each with a blade for modulating the amount of air flowing through the slots. A first blade 216 modulates the amount of air passing through the first slot 212, while a second blade 218 modulates the amount of air passing through the second slot 214. Air of one temperature, such as cool air, is supplied through the first slot 212, while air of another temperature, such as warm air is supplied through the second slot 214.

The thermal assembly 230 portion of the diffuser 210 is shown in FIG. 9. The thermal assembly 230 comprises a first thermal sensor actuator 232, a second thermal sensor actuator 234, a third thermal sensor actuator 236 and a fourth thermal sensor actuator 238, all of the type as previously described. The first and third thermal sensor actuators 232 and 236 are positioned in an induction chamber 99 to sense the temperature of the room air by means of the room air being induced through the induction chamber 99. The second and the fourth thermal sensor actuators 234 and 238 are positioned to sense the temperature of the duct air.

The first thermal sensor actuator 232 is mounted on a first bar 240. The first thermal sensor actuator 232 has a shaft 233 which is aligned to impinge against a first tab 217. The first tab 217 rotates the first shaft 215 which moves the first blade 216. When the bar 240 is in a second position, the first thermal sensor actuator 232 is disengaged from the first tab 217. The second thermal sensor actuator 234 is aligned to move the first bar 240 between a first position and a second position through a first lever 220 and a first pin 222. A first spring 244 retains the bar 240 in the first position.

The third thermal sensor actuator 236 is mounted on a second bar 242. The third thermal sensor actuator 236 has a shaft 237 which is aligned to impinge against a second tab 219, when the second bar 242 is in the second position. The second tab 219 rotates the second shaft 213 which moves the second blade 218. When the second bar 242 is in the first position, the shaft 237 of the third thermal sensor actuator 236 is disengaged from the second blade 218. The fourth thermal sensor actuator 238 is aligned to move the second bar 242 between the first position and the second position through a second lever 224 and a second pin 226. A second spring 246 retains the bar 242 in the first position.

The operation of the diffuser 210 is as follows:

Cooling Mode

When cool air is supplied through the branch duct 20, the second and the fourth thermal sensor actuators 234 and 238 are fully retracted. The first spring 244 and the second spring 246 bring the first and second bars 240 and 242, respectively, into their first position. In the first position, the first thermal sensor actuator is aligned to actuate the first tab 217. With the second bar 242 in the first position, the third thermal sensor actuator 236 is disengaged from the second tab 219. A link 250, mounted on the second bar 242 pulls the second blade 218 into a position closing off the flow of air through the second slot 214.

The first thermal sensor actuator 232 actuates the first tab 217 from a normally closed position to an open position. When the temperature of the room air warms and surpasses the temperature set point of the first thermal sensor actuator 232, the first thermal sensor actuator 232 moves the first blade 216 to an open position permitting cool air to enter into a room. When the temperature of the room is sufficently satisfied, the shaft 233 of the first thermal sensor actuator 232 retracts, causing the first blade 216 to move to a "closed" position.

Heating Mode

In the heating mode, when warm air is supplied through the branch duct 20, the warm air causes the second and fourth thermal sensor actuators 234 and 238, respectively, to expand. The expansion of the second and the fourth thermal sensor actuators 234 and 238, respectively, causes the first and second bars 240 and 242, respectively, to move into the second position. In the second position, the first thermal sensor actuator 232 is disengaged from actuating the first blade 216. In the second position of the second bar 242, a spring 252, connected to the second bar 242, pushes the second blade 218 into the "open" position permitting air to pass into the room through second slot 214. The third thermal sensor actuator 236 engages the second tab 219.

The third thermal sensor actuator 236 is now positioned to modulate the second blade 218, such that the slot 214 operates from a normally open position to a closed position. As warm air is supplied to the room, and as the room air temperature warms up, when the temperature of the room air is at the set point temperature of the third thermal sensor actuator 236, the third thermal sensor actuator would move the second blade 218 to close off the further deliverance of air from the duct 20 into the room through the slot 214.

With the slot diffuser 210, it can be seen that cool air is introduced into the room through one slot 212, while warm air is introduced into the room through the other slot 214.

There are many advantages to the apparatus of the present invention. First and foremost is that with two thermal sensor actuators sensing the room air temperature, two different temperature settings of the room can be made. For example, in the winter when warm air is supplied through the duct, one of the thermal sensor actuators can be set to respond (by closing the flow of air) at 68° F. In the summer, when cool air is supplied through the duct, the other thermal sensor actuator can be set to respond (by opening the flow of air) at 78° F. This flexibility in temperature settings results in energy conservation.

In addition, by having two thermal sensor actuators sensing the duct air temperature and each of those thermal sensor actuators acting upon one of the thermal sensor actuators for room air, further flexibility can be achieved. For example, one of the thermal sensor actuators, responsive to the duct air temperature, can be set to respond by engaging or disengaging the room air thermal sensor actuator at a different temperature than the other duct air thermal sensor actuator. One of the duct air thermal sensor actuators can be set to respond by disengaging (thereby opening the flow of air) the room air thermal sensor actuator that is responsive to cool air. The room air thermal sensor actuator which is responsive to cool air is disengaged as soon as a slight amount of warm air is detected in the duct, permitting the warm air to enter into the room as quickly as possible.

In addition, of course, by having two duct air thermal sensor actuators, each of which is responsive to actuate only one room air thermal sensor actuator, greater reliability is achieved.

I claim:

1. In a diffuser of the type for regulating the flow of air from a duct to a room or other space, said diffuser having flow control means for varying the size of an aperture in said diffuser to regulate the flow of air; first sensor actuator means responsive to a first room air temperature and operatively associated with the flow control means for modulating the flow control means when air of one temperature is supplied through the duct; second sensor actuator means responsive to the duct air temperature; wherein the improvement comprising:

said second sensor actuator means for engaging said first sensor actuator means with said flow control means when air of said one temperature is supplied through the duct and for disengaging said first sensor actuator means with said flow control means when air of another temperature is supplied through the duct;

third sensor actuator means responsive to a second room air temperature and operatively associated with the flow control means for modulating the flow control means when air of another temperature is supplied through the duct; and fourth sensor actuator means responsive to the duct air temperature and for engaging said third sensor actuator means with said flow control means when air of said another temperature is supplied through the duct and for disengaging said third sensor actuator means with said flow control means when air of one temperature is supplied through the duct.

2. The diffuser of claim 1, wherein said one temperature is cooler than said another temperature.

3. The diffuser of claim 2, wherein said first room air temperature is warmer than said second room air temperature.

4. A diffuser for regulating the volume of flow of air from a duct to a room or other space, comprising:

flow control means for varying the size of an aperture in the diffuser to regulate the volume flow of air from the duct through the diffuser and into the room or other space;

first sensor actuator means responsive to a first room air temperature and operatively associated with the flow control means for modulating the flow control means in a normally closed to open mode of operation in response to changes in room temperature when air of one temperature is supplied through the duct;

second sensor actuator means responsive to a first duct air temperature for disengaging said first sensor actuator means with the flow control means when air of another temperature is supplied through the duct;

third sensor actuator means responsive to a second room air temperature and operatively associated with the flow control means for modulating the flow control means in a normally open to closed mode of operation in response to changes in room temperature when air of another temperature is supplied through the duct; and fourth sensor actuator means responsive to a second duct air temperature for engaging said third sensor actuator means with the flow control means when air of another temperature is supplied through the duct.

5. The diffuser of claim 4, wherein said another temperature is warmer than said one temperature.

6. The diffuser of claim 5, wherein said first duct air temperature is cooler than said second duct air temperature.

7. The diffuser of claim 6, wherein said first room air temperature is warmer than said second room air temperature.

8. A diffuser for regulating the volume of flow of air from a duct to a room or other space, comprising:

flow control means for varying the size of an aperture in the diffuser to regulate the volume flow of air from the duct through the diffuser and into the room or other space;

first sensor actuator means responsive to a first room air temperature and operatively associated with the flow control means for modulating the flow control means in a normally closed to open mode of operation in response to changes in room temperature when air of one temperature is supplied through the duct;

second sensor actuator means responsive to duct air temperature for opening said aperture when air of another temperature is supplied through the duct; said another temperature warmer than said one temperature;

said first sensor actuator means for closing said aperture and for reopening it in response to air of another temperature supplied to said room; said first sensor actuator being disengaged from said flow control means;

third sensor actuator means responsive to a second room air temperature and operatively associated with the flow control means for modulating the flow control means in a normally open to closed mode of operation in response to changes in room temperature when air of another temperature is supplied through the duct; and fourth sensor actuator means responsive to duct air temperature for engaging said third sensor actuator means with said flow control means when air of another temperature is supplied through the duct.

* * * * *